US009599331B2

(12) United States Patent
Lv et al.

(10) Patent No.: US 9,599,331 B2
(45) Date of Patent: Mar. 21, 2017

(54) FURNACE OF CIRCULATING FLUIDIZED BED BOILER HAVING VARIABLE CROSS-SECTION WATER-COOLED COLUMN

(71) Applicant: Institute of Engineering Thermophysics, Chinese Academy of Sciences, Beijing (CN)

(72) Inventors: Qinggang Lv, Beijing (CN); Ming Gao, Beijing (CN); Dongyu Wang, Beijing (CN); Xiaofang Wang, Beijing (CN)

(73) Assignee: Institute of Engineering Thermophysics, Chinese Academy of Sciences, Beijing (CN)

( * ) Notice: Subject to any disclaimer, the term of this patent is extended or adjusted under 35 U.S.C. 154(b) by 0 days.

(21) Appl. No.: 14/909,224

(22) PCT Filed: Oct. 8, 2014

(86) PCT No.: PCT/CN2014/088125
§ 371 (c)(1),
(2) Date: Feb. 1, 2016

(87) PCT Pub. No.: WO2015/018379
PCT Pub. Date: Feb. 12, 2015

(65) Prior Publication Data

US 2016/0178191 A1 Jun. 23, 2016

(30) Foreign Application Priority Data

Aug. 9, 2013 (CN) ..... 2013 1 0346673

(51) Int. Cl.
*F22B 37/12* (2006.01)
*F23C 10/10* (2006.01)
(Continued)

(52) U.S. Cl.
CPC ..... *F22B 37/12* (2013.01); *F01K 5/02* (2013.01); *F22B 21/02* (2013.01); *F22B 31/003* (2013.01); *F22B 31/0084* (2013.01); *F23C 10/10* (2013.01)

(58) Field of Classification Search
CPC ..... F23C 2900/10003; F22B 37/12
(Continued)

(56) References Cited

U.S. PATENT DOCUMENTS 3,105,466 A * 10/1963 Evans ..... F22B 29/064 122/235.12
4,546,731 A * 10/1985 Ammann ..... F22B 37/14 122/235.12
(Continued)

FOREIGN PATENT DOCUMENTS

CN 100523606 C 8/2009
CN 201662046 U 12/2010
(Continued)

OTHER PUBLICATIONS

International Search Report (in English) and Written Opinion (in Chinese) for International Patent Application No. PCT/CN2014/088125, dated Jan. 16, 2015, 6 pages.
(Continued)

*Primary Examiner* — Gregory A Wilson
(74) *Attorney, Agent, or Firm* — Westman, Champlin & Koehler, P.A.

(57) ABSTRACT

Embodiments of the invention provide a water-cooled column formed by side walls connected together to define an enclosed space, each side wall is formed of a water-cooled membrane wall, a working medium is passed through a tube of the water-cooled membrane wall from bottom to top, the water-cooled column comprising: a lower part having a cross section reduced segment, which has a cross section
(Continued)

gradually reduced in a direction from bottom to top; and an upper part, wherein the upper part connects with the cross section reduced segment at a connection position, and a cross sectional area of the cross section reduced segment at the connection position is identical to a cross sectional area of the upper part at the connection position. Embodiments of the invention also provide a furnace for defining a reaction space, which comprises a water-cooled column defined as above disposed along a vertical direction therein.

15 Claims, 3 Drawing Sheets

(51) Int. Cl.
*F01K 5/02* (2006.01)
*F22B 21/02* (2006.01)
*F22B 31/00* (2006.01)

(58) Field of Classification Search
USPC ..... 122/235.12, 235.14, 488, 494
See application file for complete search history.

(56) References Cited

U.S. PATENT DOCUMENTS 5,239,945 A * 8/1993 McCoy ..... F22B 31/003 110/245
5,678,497 A * 10/1997 Goidich ..... F23C 10/02 110/245
5,775,265 A 7/1998 Brandle et al.
5,836,257 A * 11/1998 Belin ..... F22B 31/0084 110/234
6,029,612 A * 2/2000 Wietzke ..... F23C 10/20 110/245
6,470,833 B1 10/2002 Hyppänen
6,793,013 B2 * 9/2004 Gounder ..... B04C 5/081 122/235.12
8,506,665 B2 * 8/2013 Lankinen ..... B04C 5/14 55/428
2006/0124077 A1 * 6/2006 Weissinger ..... F22B 31/0038 122/4 D
2014/0299027 A1 10/2014 Lu et al.
2015/0184847 A1 7/2015 Lv et al.

FOREIGN PATENT DOCUMENTS

CN 102226518 A 10/2011
CN 102466223 A 5/2012
CN 102635854 A 8/2012
CN 102997231 A 3/2013
CN 103216809 A 7/2013
CN 103216822 A 7/2013

OTHER PUBLICATIONS

First Office Action, including Search Report, for Chinese Patent Application No. 201310346673.8, dated Apr. 6, 2016, 6 pages.

* cited by examiner

I-Enlarged

II-Enlarged

FURNACE OF CIRCULATING FLUIDIZED BED BOILER HAVING VARIABLE CROSS-SECTION WATER-COOLED COLUMN

CROSS-REFERENCE TO RELATED APPLICATION

This application is a Section 371 National Stage Application of International Application No. PCT/CN2014/088125, filed on 8 Oct. 2014, entitled "CIRCULATING FLUIDIZED BED BOILER FURNACE HAVING A VARIABLE CROSS-SECTION WATER-COOLED CYLINDER", which claims priority to Chinese Application Serial No. 201310346673.8, filed on 9 Aug. 2013, incorporated herein by reference in their entirety.

BACKGROUND OF THE INVENTION

Field of the Invention

Embodiments of the invention relates to a boiler of a circulating fluidized bed, in particular to a furnace of a large size circulating fluidized bed boiler.

Description of the Related Art

Large-sizes and high-parameters are the inevitable trend of technological development of boilers for circulating fluidized beds. As a capacity of a boiler and an area of a cross section of a furnace increase, it is difficult for a secondary air to reach the center of the furnace; and at the same time, As parameters of boiler steam raise, especially when the parameter are raised to supercritical or ultra-supercritical steam parameters, heat releasing volume of a furnace increases faster than a heating surface of the furnace does, thus, an unbalanced growth between heat releasing and heat absorption leads to a problem concerning the arrangement of the heat plate. Therefore, passage of the secondary air and arrangement of the heat plate have become main bottlenecks that constraint the trend of technological development of circulating fluidized bed boilers toward large-sizes and high-parameters.

To solve the problem of passage of secondary air, Chinese Patent ZL 200710151813.0 discloses a furnace of a circulating fluidized bed boiler having a water-cooled column, the water-cooled column formed by membrane walls is disposed between an air distributing plate and a ceiling of the furnace to increase an area of the heat plate of the furnace, and secondary air is passed through the water-cooled column to the combustion chamber of the furnace. Since conducts for the secondary air should be arranged inside of the water-cooled column and require a certain space for arranging the conduits and maintenance, sizes of the cross section of the water-cooled column according to conventional designs will be relatively larger, which will lead to a small distance between an inner wall and an outer wall of the combustion chamber of the furnace having an annular shape, such that mixing of materials inside the furnace and arrangement of plate-typed heating plate will be adversely affected. In addition, generally, when only one conventional square water-cooled column is disposed inside the chamber, lower parts of four water-cooled sidewalls of the furnace are inclined inwardly, in order to provide a combustion space of the furnace having a cross section that increases gradually. In such a manner, the design and arrangement of the water-cooled sidewalls of the furnace are relatively complicated.

SUMMARY OF THE INVENTION

According to one aspect of the invention, there is provided a water-cooled column, formed by side walls that are connected together to define and surround an enclosed space, each side wall is a water-cooled membrane wall, a working medium is passed through a tube of the water-cooled membrane wall from bottom to top, and the water-cooled column comprises: a lower part having a cross section reduced segment, the cross section reduced segment having a cross section gradually reduced in a direction from bottom to top; and an upper part, wherein the upper part of the water-cooled column connects with the cross section reduced segment at a connection position, and a cross sectional area of the cross section reduced segment at the connection position is identical to a cross sectional area of the upper part of the water-cooled column at the connection position.

Optionally, the upper part of the water-cooled column has a constant cross section shape and a constant cross sectional area.

Optionally, the side walls of water-cooled column are provided with an air outlet at the cross section reduced segment.

According to another aspect of the invention, there is provided furnace for defining a reaction space comprising a water-cooled column defined as above and disposed along a vertical direction in the furnace.

The furnace may be a furnace of a circulating fluidized bed boiler, and the furnace comprises furnace side walls, a ceiling, an air distributing plate, and the water-cooled column disposed between the air distributing plate and the ceiling; outer sides of the water-cooled column face a combustion space of the furnace used as the reaction space. An inner secondary air port for introducing a secondary air into the combustion space of the furnace is provided in the side walls of the water-cooled column at the lower part. Through providing one or more variable cross-section water-cooled columns having a relative larger cross sectional area at lower part thereof in a furnace, the lower part of the water-cooled column provides sufficient space for arranging a secondary air tube and for maintenance; an upper part of the water-cooled column has a relative small cross sectional area, such that side walls of the water-cooled column is relatively faraway spaced apart from the side walls of the furnace, when a panel-typed heating plate is provided on the side walls of the water-cooled column, there is a sufficient space to avoid an interference to the flow field at an upper portion of the furnace caused by the panel-typed heating plate disposed within a narrow and an abrasion of the heating plate due to positioning the heating plate too close to exhaust gases from the furnace.

Optionally, the lower part of the water-cooled column comprises the cross section reduced segment and a vertical segment, the vertical segment has a constant cross sectional area and is located between the cross section reduced segment and the air distributing plate.

Optionally, the cross section reduced segment is located between the air distributing plate and the upper part of the water-cooled column.

Advantageously, the inner secondary air port is positioned in the side walls of the water-cooled column at the cross section reduced segment.

Optionally, the water-cooled column comprises a pair of parallel side walls, which extend from the air distributing plate to the ceiling in the vertical direction. Advantageously, the furnace side walls comprise a pair of side walls facing the pair of parallel side walls of the water-cooled column respectively, and lower parts of the pair of side walls of the furnace extend obliquely upwards away from corresponding side walls of the water-cooled column.

Optionally, side walls of the furnace, which face sidewalls of the cross section reduced segment of the water-cooled column extending obliquely, extend in the vertical direction.

Optionally, there is only one water-cooled column disposed in the furnace.

Optionally, a cross section of the furnace is a rectangle; and the water-cooled column is formed by four water-cooled membrane walls that are connected together to define and surround an enclosed space, one pair of water-cooled membrane walls of the four water-cooled membrane walls opposite to each other extend in parallel vertically, and the other pair of water-cooled membrane walls of the four water-cooled membrane walls opposite to each other extend obliquely upwards to approach each other in the vertical direction at the cross section reduced segment.

Optionally, the furnace of the circulating fluidized bed boiler has an octagonal cross section and comprises: a front wall, a rear wall, a left side wall, a right side wall, a left front wall, a right front wall, a left rear wall, and a right rear wall; the water-cooled column is formed by eight water-cooled membrane walls connected together to define and surround an enclosed space and comprising: a front wall and a rear wall disposed opposite to each other and facing towards the front wall and the rear wall of the furnace respectively; a left side wall and a right side wall disposed opposite to each other and facing towards the left side wall and the right side wall of the furnace respectively; a left front wall located between the front wall and the left wall of the water-cooled column; a right front wall located between the front wall and the right wall of the water-cooled column; a left rear wall located between the rear wall and the left wall of the water-cooled column; and a right rear wall located between the rear wall and the right wall of the water-cooled column; one pair of opposite side walls of the front wall, the rear wall, the left side wall and the right side wall of the water-cooled column extend vertically upwards; lower parts of the other pair of opposite side walls of the front wall, the rear wall, the left side wall and the right side wall of the water-cooled column extend vertically upwards and incline inwards at the same time; the left front wall, the right front wall, the left rear wall and the right rear wall of the water-cooled column extend upwards and adaptively incline inwards at the same time so as to keep a connecting relationship with associated side walls of the water-cooled column to define and surround the enclosed space, then end the inward inclination and start to extend vertically upwards when they have extended to a certain position where the left and right side walls start to extend vertically upwards from the inward inclination, such that a cross section of an upper part of the water-cooled column has a shape of concaved octagon. Or, the furnace of the circulating fluidized bed boiler has an octagonal cross section and comprises: a front wall, a rear wall, a left side wall, a right side wall, a left front wall, a right front wall, a left rear wall, and a right rear wall; the lower part of the water-cooled column is formed by eight water-cooled membrane walls connected together to define and surround the enclosed space and comprising: a front wall and a rear wall disposed opposite to each other and facing towards the front wall and the rear wall of the furnace respectively; a left side wall and a right side wall disposed opposite to each other and facing towards the left side wall and the right side wall of the furnace respectively; a left front wall located between the front wall and the left wall of the water-cooled column; a right front wall located between the front wall and the right wall of the water-cooled column; a left rear wall located between the rear wall and the left wall of the water-cooled column; and a right rear wall located between the rear wall and the right wall of the water-cooled column; at the cross section reduced segment, each of the front wall, the rear wall, the left side wall and the right side wall of the water-cooled column extends obliquely upwards to provide a rectangular cross section, and each of the left front wall, the right front wall, the left rear wall and the right rear wall extends obliquely upwards and ends at a corresponding corner of the rectangular cross section. When the cross section of the furnace has an octagonal shape, the cross section of the bottom of the water-cooled column also has an octagonal shape, and the cross section of the upper part of the water-cooled column has a concaved octagonal shape or a quadrangular shape; the lower part of the water-cooled column reduces its cross section from top to bottom, such that the side walls of the furnace may be kept vertical, and thereby simplifying a structure in which all eight side walls should be inclined inwards.

Optionally, a cross section of the furnace is a rectangle; and at least two water-cooled columns are disposed in the furnace and spaced apart from each other; each water-cooled column is formed by four water-cooled membrane walls that are connected together to define and surround the enclosed space, one pair of water-cooled membrane walls of the four water-cooled membrane walls opposite to each other extend in parallel vertically, and the other pair of water-cooled membrane walls of the four water-cooled membrane walls opposite to each other extend obliquely upwards to approach each other in the vertical direction at the cross section reduced segment; and the at least two water-cooled columns have the same structure, and the water-cooled membrane walls of one of the water-cooled columns extending vertically at the cross section reduced segment are in parallel with the water-cooled membrane walls of the other of the water-cooled columns extending vertically at the cross section reduced segment.

Advantageously, a panel-typed heating plate is disposed at the upper part of the water-cooled column.

According to a further aspect of the invention, there is provided a furnace of the circulating fluidized bed boiler, which comprises furnace side walls, a ceiling, an air distributing plate, and the water-cooled column disposed between the air distributing plate and the ceiling; the cross section reduced segment has inclined side walls that incline inwardly to the inside of the water-cooled column; and side walls of the furnace facing the inclined side walls of the cross section reduced segment extend in the vertical direction.

According to a still further aspect of the invention, there is provided a furnace of the circulating fluidized bed boiler, which comprises furnace side walls, a ceiling, an air distributing plate, and the water-cooled column disposed between the air distributing plate and the ceiling; and the lower part of the water-cooled column provides an internal space for arranging a secondary air tube therein.

As compared with prior arts, at least one of the following advantages can be achieved by the furnace for large-size circulating fluidized bed boiler according to embodiments of the invention: a volume of the water-cooled column inside the furnace may be significantly reduced, such that a sufficient space may be provided to arranging a panel-typed heating plate at the upper part of the furnace, the panel has a small interference to the flow field, and an abrasion of the panel is reduced; it is convenient to arrange tubes for secondary air inside of the water-cooled column, the space is sufficient and thereby maintenance is convenient; at the same time, the structure of the water cooled side walls of the furnace can be simplified.

DETAILED DESCRIPTION OF PREFERRED EMBODIMENTS OF THE INVENTION

Figure 1:
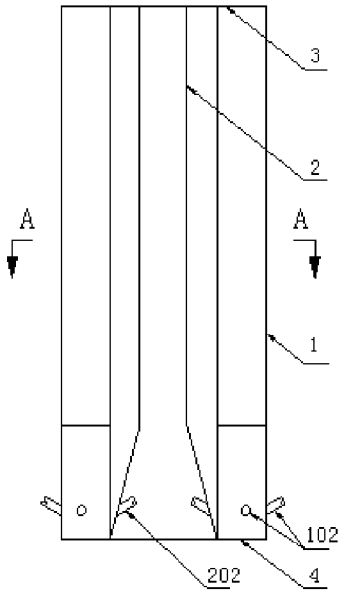
FIGS. 1 to 3 schematically show a front view, a side view, and a cross-sectional view of a furnace of a circulating fluidized bed boiler having variable cross-section water-cooled column according to embodiment I of the invention, respectively.
Figure 2:
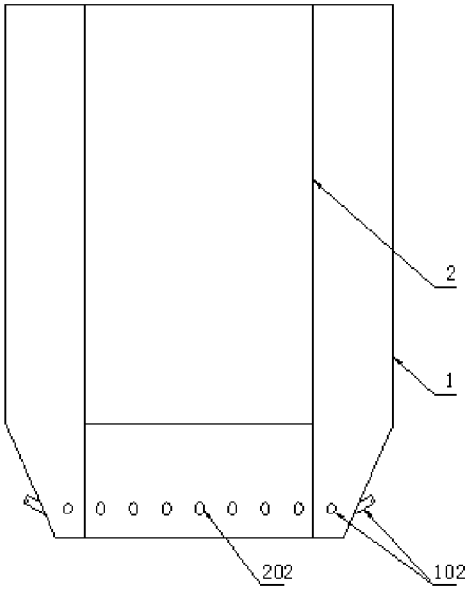
Figure 3:
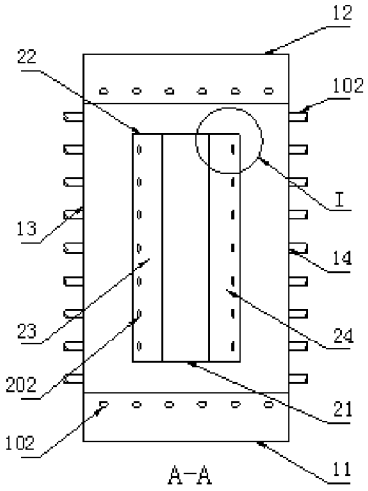

Exemplary embodiments of the invention shown in the accompanying drawings will be described in detail below, where the same or similar reference numerals represent the same or similar elements. Embodiments set forth below with reference to the accompanying drawings are exemplary and intended to explain the invention, and should not to be construed as limitations to the invention.

A furnace of a circulating fluidized bed boiler having a variable cross-section water-cooled column will be described with reference to FIGS. 1-14.

A furnace of a circulating fluidized bed boiler, which has a quadrangle-shaped cross section, comprises: furnace side walls 11-14 (a front wall 11, a rear wall 12, a left side wall 13, and a right side wall 14, respectively); a ceiling 3; an air distributing plate 4 disposed at the bottom of the furnace; and at least one water-cooled column 2 disposed between the air distributing plate and the ceiling. The water-cooled column 2 is formed by four water-cooled membrane walls connected together to define and surround an enclosed space, and the four membrane walls comprises: a front wall 21 and a rear wall 22 disposed opposite to each other and facing towards the front wall and the rear wall of the furnace respectively; and a left side wall 23 and a right side wall 24 disposed opposite to each other and facing towards the left side wall and the right side wall of the furnace, respectively. A cross section of the water-cooled column 2 at the air distributing plate 4 is in the shape of a rectangle.

Wherein: the water-cooled column 2 extends from the air distributing plate 4 up to the ceiling 3 of the furnace, and when the water-cooled column extends from bottom to top, a set of opposite side walls of the water-cooled column incline synchronously, at a position of the air distributing plate 4 or above the air distributing plate 4, towards the inner side of the column, such that a distance therebetween is reduced; when the distance is reduced to a certain value, the side walls start to extend vertically upwards; the other set of opposite side walls of the water-cooled column keep extending upwards in parallel, such that an upper part of the water-cooled column has a "凵" shape with one set of opposite side walls extending beyond the other set of opposite side walls, while the space enclosed by the four side walls is still in a rectangular shape. An area of a cross section of the space inside an upper part of the water-cooled column is smaller than an area of a cross section of the space inside a lower part of the water-cooled column. The inclined segment of the side walls of the water-cooled column is provided with inner secondary air ports 202, and outer secondary air ports 102 may be provided at a region corresponding to or approximately corresponding to the inner secondary air ports.

To ensure that the air distributing plate 4 has a large enough area, the position where the lower part of the water-cooled column starts to incline is located lower than the inner secondary air port 202.

Lower parts of the front and rear walls 11, 12 of the furnace are inclined outwardly and provided with outer secondary air ports. The right and left side walls 13, 14 of the furnace are vertical from bottom to top and also provided with outer secondary air ports.

Figure 4:
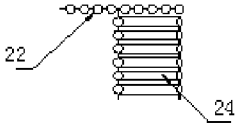
FIG. 4 is a partial enlarged schematic drawing showing the water-cooled column of the furnace of the circulating fluidized bed boiler having variable cross-section water-cooled column according to embodiment I of the invention.

FIG. 4 is a partial enlarged drawing of the top view of the water-cooled column, in which the inner secondary air ports 202 are not shown.

Figure 5:
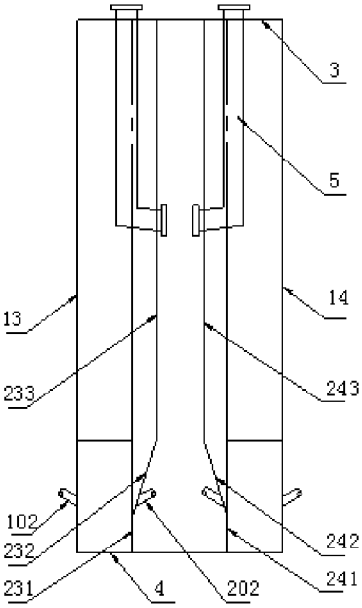
FIG. 5 is a front view showing another variable cross-section water-cooled column disposed in the furnace of the circulating fluidized bed boiler having variable cross-section water-cooled column according to embodiment I of the invention.
Figure 6:
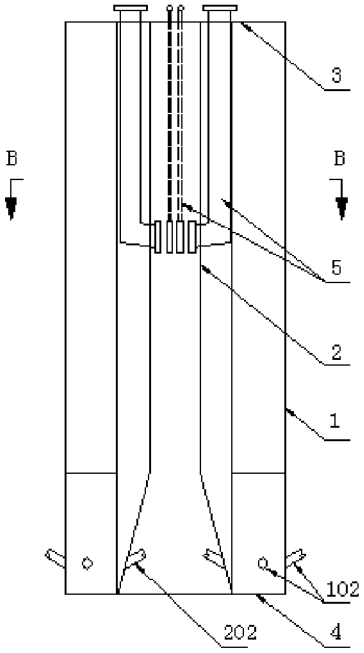
FIGS. 6 to 8 schematically show a front view, a side view, and a cross-sectional view of a furnace of a circulating fluidized bed boiler having variable cross-section water-cooled column according to embodiment II of the invention, respectively.
Figure 7:
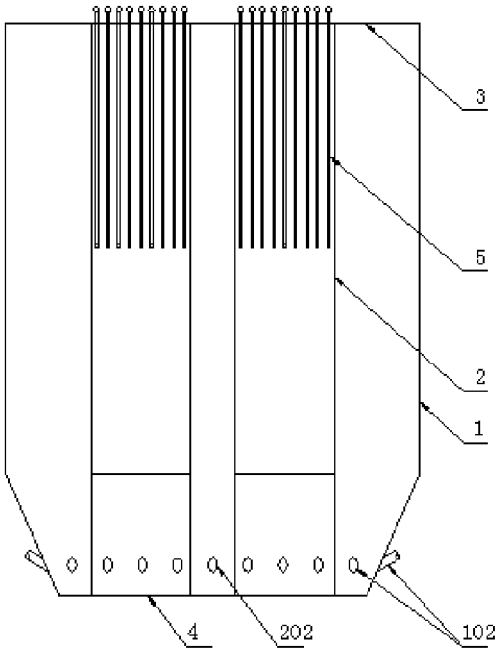
Figure 8:
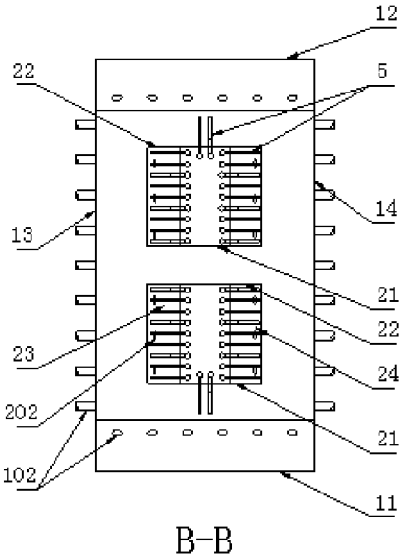
Figure 9:
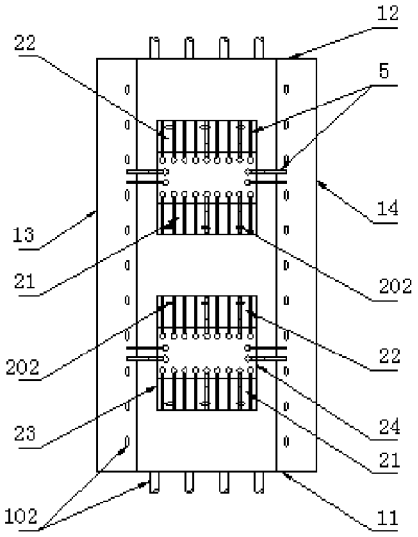
FIG. 9 is a top view showing a furnace of a circulating fluidized bed boiler having variable cross-section water-cooled column according to embodiment III of the invention.
Figure 10:
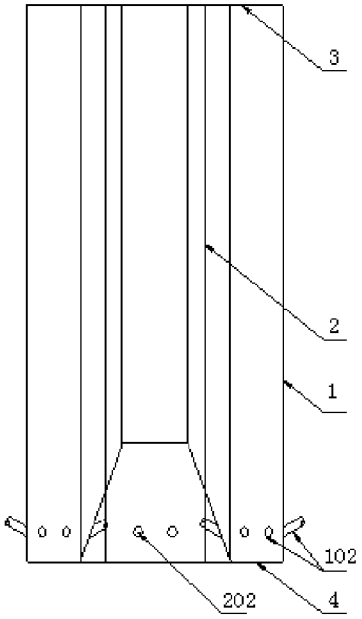
FIGS. 10 to 12 schematically show a front view, a side view, and a cross-sectional view of a furnace of a circulating fluidized bed boiler having variable cross-section water-cooled column according to embodiment IV of the invention, respectively.
Figure 11:
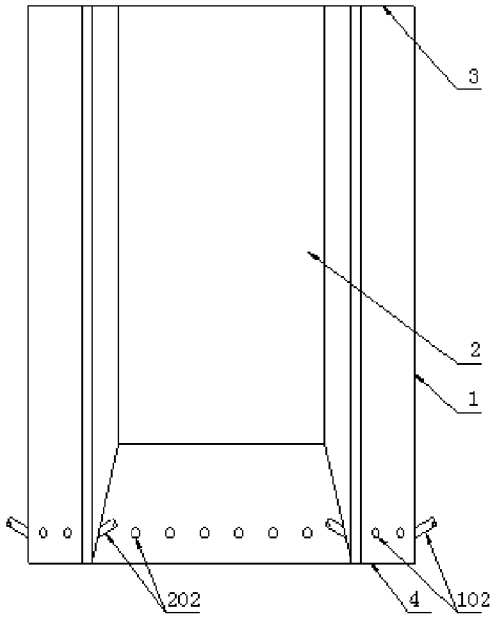

Optionally, a panel-typed heating plate 5 may be disposed at upper parts of the left side wall 23 and the right side wall 24, as shown in FIG. 5.

Optionally, as shown in FIG. 5, to ensure that the air distributing plate has a large enough area, the left side wall 23 and the right side wall 24 of the water-cooled column may comprise vertical segments 231, 241, then inwardly inclined segments 232, 242, and then vertical segments 233, 243 respectively; the vertical segments 231, 241 are not higher than the inner secondary air ports 202.

The lower parts of the side walls of the water-cooled column that incline inward form a cross-section reduced segment of the water-cooled column. A distance between the two side walls having the inclined segments should be determined based on requirements for maintenance, heat dissipation, or the positioning of the panel-typed heating plate. A height of the inclined segments should be determined based on the requirement for distributing the secondary air.

As shown in FIGS. 1-5, when one water-cooled column 2 is disposed inside the furnace, preferably, the side walls having the inclined segments are the side walls facing two opposite side walls of the furnace that have a relative large distance therebetween. As shown in FIG. 1, a distance between the left and right side walls 13, 14 is larger than a distance between the front and rear walls 11, 12 of the furnace, so that lower parts of the left side wall 23 and right side wall 24 of the water-cooled column incline inwards when they extend from bottom to top.

When a plurality of water-cooled columns are to be provided, As shown in FIGS. 6 to 8, and 9, two water-cooled columns are disposed side by side along a central line of the furnace. The side walls having the inclined segments may be the side walls facing two opposite side walls of the furnace that have a relative large distance therebetween (see FIG. 8), or they may be the other set of opposite side walls (see FIG. 9). However, the design for the two water-cooled columns should be the same. As compared with a design in which only one water-cooled column is provided, a cross section of the combustion space inside the furnace of FIG. 8 has a "⊓" shape. Materials at left and right sides of the water-cooled columns have passages for exchange, such that this design may be used in a boiler furnace having an even larger volume. The design of FIG. 9 has a structure which is more convenient for distributing a secondary air, and the secondary air may be distributed uniformly to every region inside of the furnace.

Lower parts of the side walls of the furnace corresponding to the inclined segments of the side walls of the water-cooled column may be vertical, so as to simplify the structure of the side walls of the furnace.

Figure 12:
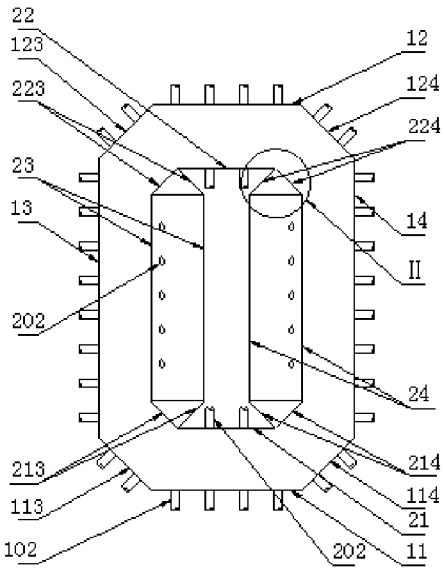
Figure 13:
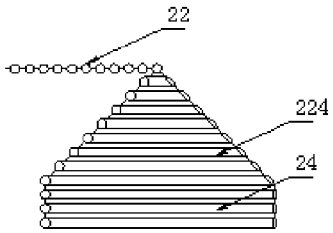
FIG. 13 is a partial enlarged schematic drawing showing the variable cross-section water-cooled column according to embodiment IV of the invention.
Figure 14:
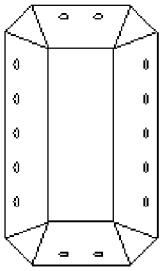
FIG. 14 is a top view showing another variable cross-section water-cooled column according to embodiment IV of the invention.

As shown in FIGS. 12-14, a furnace of a circulating fluidized bed boiler, which has a octagon-shaped cross section, has an shape and comprises: side walls (a front wall 11, a rear wall 12, a left side wall 13, and a right side wall 14, respectively) of the furnace, a left front wall 113, a right front wall 114, a left rear wall 123, and a right rear wall 124; a ceiling 3; an air distributing plate 4 disposed at the bottom of the furnace; and at least one water-cooled column 2 disposed between the air distributing plate and the ceiling. The water-cooled column 2 is formed by eight water-cooled membrane walls connected together to define and surround an enclosed space, and comprises: a front wall 21 and a rear wall 22 disposed opposite to each other and facing towards the front wall and the rear wall of the furnace respectively; a left side wall 23 and a right side wall 24 disposed opposite to each other and facing towards the left side wall and the right side wall of the furnace respectively; a left front wall 213 located between the front wall 21 and the left wall 23 of the water-cooled column; a right front wall 214 located between the front wall 21 and the right wall 24 of the water-cooled column; a left rear wall 223 located between the rear wall 22 and the left wall 23 of the water-cooled column; and a right rear wall 224 located between the rear wall 22 and the right wall 24 of the water-cooled column.

A cross section of the water-cooled column 2 at the air distributing plate 4 is in the shape of an octagon. The front wall 21 and the rear wall 22 of the water-cooled column extend vertically upwards. Lower parts of the left side wall 23 and the right side wall 24 of the water-cooled column extend vertically upwards and incline inwards at the same time, when extend to a certain position above the air distributing plate, the left side wall and the right side wall of the water-cooled column start to extend vertically upwards. The left front wall 213, the right front wall 214, the left rear wall 223 and the right rear wall 224 extend upwards and adaptively incline inwards at the same time, and keep a connecting relationship with the side walls so as to define and surround the enclosed space, then end the inward inclination and start to extend vertically upwards when they extend to the certain position where the left and right side walls start to extend vertically upwards, such that a cross section of an upper part of the water-cooled column has a shape of concaved octagon. Panel-typed heating plates may be provided at upper parts of the left and right side walls 23, 24, and inner secondary air ports 202 may be provided at lower parts of the left and right side walls. FIG. 13 is a partial enlarged schematic view showing the water-cooled column.

The variable cross section of the water-cooled column 2 may also be obtained through extending eight lower side walls upwards and inwards in a Y-shaped tube manner or a compromised manner, or the like, until a rectangle is formed. A projection of the rectangle on the air distributing plate is located entirely within a cross section of the water-cooled column at the air distributing plate, and four sides of the rectangle are in parallel with four side walls of the furnace, respectively, as shown in FIG. 14.

Embodiments of the invention provides a furnace for a the circulating fluidized bed boiler, the furnace comprises furnace side walls, a ceiling, an air distributing plate, and the water-cooled column disposed between the air distributing plate and the ceiling. The water-cooled column is formed by water-cooled membrane walls; a working medium is passed through a tube of the water-cooled membrane wall from bottom to top; outside of the water-cooled column is a combustion space of the furnace; and an inner secondary air port for introducing a secondary air into the combustion space is provided at a lower part of the water-cooled column; wherein, the lower part of the water-cooled column having a cross section reduced segment, cross sectional area of the cross section reduced segment gradually reduces to an cross sectional area of an upper part of the water-cooled column in the vertical direction; and the cross section reduced segment is connected to the upper part of the water-cooled column.

The following ways may be used to make the lower part of the water-cooled column have a larger cross sectional area than that of the upper part thereof.

Take a water-cooled column, a lower part of which has a quadrangular cross section, for example, one pair of opposite side walls of the water-cooled column extend obliquely inwards from the air distributing plate to the ceiling, and when extend to a certain height, the pair of side walls start to extend vertically upwards and keep a certain distance therebetween at the same time; the other pair of opposite side walls of the water-cooled column keep extending vertically.

Take a water-cooled column, a lower part of which has an octagonal cross section, for example, one pair of opposite side walls of the water-cooled column keep extending vertically, other three pairs of opposite side walls of the water-cooled column extend obliquely inwards from the air distributing plate to the ceiling, and when extend to a certain height, the other three pair of side walls start to extend vertically upwards and keep a certain distance therebetween at the same time, such that a cross section of a upper part of the water-cooled column is in the shape of a concaved octagon or a rectangle.

Take a water-cooled column, a lower part of which has an hexagonal cross section, for example, one pair of opposite side walls of the water-cooled column keep extending vertically, other two pairs of opposite side walls of the water-cooled column extend obliquely inwards from the air distributing plate to the ceiling, and when extend to a certain height, the other three pair of side walls start to extend vertically upwards and keep a certain distance therebetween at the same time, such that a cross section of a upper part of the water-cooled column is in the shape of a concaved hexagon or a rectangle.

Embodiments of the invention also provide a furnace of a circulating fluidized bed boiler, and the furnace comprises furnace side walls, a ceiling, an air distributing plate, and a water-cooled column disposed between the air distributing plate and the ceiling. A lower part of the water-cooled column has a cross section reduced segment formed by a plurality of side walls of the water-cooled column that are connected together to define and surround an enclosed space; the cross section reduced segment is connected to an upper part of the water-cooled column and has inclined side walls that incline inwardly to the inside of the water-cooled column; and side walls of the furnace facing the inclined side walls of the cross section reduced segment extend in the vertical direction.

Embodiments of the invention also provide a furnace of a circulating fluidized bed boiler, and the furnace comprises furnace side walls, a ceiling, an air distributing plate, and the water-cooled column disposed between the air distributing plate and the ceiling. The water-cooled column comprises a lower part and an upper part, a cross sectional area of the lower part of the water-cooled column is larger than that of the upper part, and the cross section of the lower part of the water-cooled column gradually transits to the cross section of the upper part of the water-cooled column, and the lower part of the water-cooled column provides an internal space for arranging a secondary air tube therein.

Advantageously, in the furnace of the circulating fluidized bed boiler, the upper part of the water-cooled column has a constant cross section shape and a constant cross sectional area.

Embodiments of the invention also provides a water-cooled column formed by side walls that are connected together to define and surround an enclosed space, each side wall is a water-cooled membrane wall, a working medium is passed through a tube of the water-cooled membrane wall from bottom to top, and the water-cooled column comprises: a lower part having a cross section reduced segment, the cross section reduced segment having a cross section gradually reduced in a direction from bottom to top; and an upper part, wherein the upper part of the water-cooled column connects with the cross section reduced segment at a connection position, and a cross sectional area of the cross section reduced segment at the connection position is identical to a cross sectional area of the upper part of the water-cooled column at the connection position. Herein, "identical" means that the shape of the cross section and the cross sectional area of the cross section reduced segment at the connection position are the same as the shape of the cross section and the cross sectional area of the upper part of the water-cooled column at the connection position, respectively, and the two cross sections are orientated towards the same direction.

Advantageously, the upper part of the water-cooled column has a constant cross section shape and a constant cross sectional area.

Advantageously, the side walls of water-cooled column are provided with an air outlet at the cross section reduced segment.

Correspondingly, embodiments of the invention also provide a furnace for defining a reaction space, the furnace comprises a water-cooled column as described above disposed along a vertical direction in the furnace.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A furnace for a circulating fluidized bed boiler, comprising:

furnace side walls;

a ceiling;

an air distributing plate; and a water-cooled column disposed between the air distributing plate and the ceiling along a vertical direction, the water-cooled column being formed by side walls of the water-cooled column that are connected together to define and surround an enclosed space, each side wall of the water-cooled column being a water-cooled membrane wall, a working medium being passed through a tube of the water-cooled membrane wall from bottom to top, the water-cooled column comprising:

a lower part having a cross section reduced segment, the cross section reduced segment having a cross section gradually reduced in a direction from bottom to top; and an upper part connected with the cross section reduced segment at a connection position, a cross section of the cross section reduced segment at the connection position being identical to a cross section of the upper part at the connection position, wherein outer sides of the water-cooled column face a combustion space of the furnace used as the reaction space; and wherein an inner secondary air port for introducing a secondary air into the combustion space of the furnace is provided in the side walls of the water-cooled column at the lower part.

2. The furnace according to claim 1, wherein the lower part of the water-cooled column comprises the cross section reduced segment and a vertical segment, the vertical segment has a constant cross sectional area and is located between the cross section reduced segment and the air distributing plate.

3. The furnace according to claim 2, wherein the cross section reduced segment is located between the air distributing plate and the upper part of the water-cooled column.

4. The furnace according to claim 2, wherein the inner secondary air port is positioned in the side walls of the water-cooled column at the cross section reduced segment.

5. The furnace according to claim 1, wherein the water-cooled column comprises a pair of parallel side walls, which extend from the air distributing plate to the ceiling in the vertical direction.

6. The furnace according to claim 5, wherein the furnace side walls comprise a pair of side walls facing the pair of parallel side walls of the water-cooled column respectively, and lower parts of the pair of side walls of the furnace extend obliquely upwards away from corresponding side walls of the water-cooled column.

7. The furnace according to claim 1, wherein side walls of the furnace, which face sidewalls of the cross section reduced segment of the water-cooled column extending obliquely, extend in the vertical direction.

8. The furnace according to claim 1, wherein there is only one water-cooled column disposed in the furnace.

9. The furnace according to claim 8, wherein:

a cross section of the furnace is a rectangle; and the water-cooled column is formed by four water-cooled membrane walls that are connected together to define and surround an enclosed space, one pair of water-cooled membrane walls of the four water-cooled membrane walls opposite to each other extend in parallel vertically, and the other pair of water-cooled membrane walls of the four water-cooled membrane walls opposite to each other extend obliquely upwards to approach each other in the vertical direction at the cross section reduced segment.

10. The furnace according to claim 8, wherein:

the furnace of the circulating fluidized bed boiler has an octagonal cross section and comprises: a front wall, a rear wall, a left side wall, a right side wall, a left front wall, a right front wall, a left rear wall, and a right rear wall;

the water-cooled column is formed by eight water-cooled membrane walls connected together to define and surround an enclosed space and comprising: a front wall and a rear wall disposed opposite to each other and facing towards the front wall and the rear wall of the furnace respectively; a left side wall and a right side wall disposed opposite to each other and facing towards the left side wall and the right side wall of the furnace respectively; a left front wall located between the front wall and the left wall of the water-cooled column; a right front wall located between the front wall and the right wall of the water-cooled column; a left rear wall located between the rear wall and the left wall of the water-cooled column; and a right rear wall located between the rear wall and the right wall of the water-cooled column;

one pair of opposite side walls of the front wall, the rear wall, the left side wall and the right side wall of the water-cooled column extend vertically upwards; lower parts of the other pair of opposite side walls of the front wall, the rear wall, the left side wall and the right side wall of the water-cooled column extend vertically upwards and incline inwards at the same time; the left front wall, the right front wall, the left rear wall and the right rear wall of the water-cooled column extend upwards and adaptively incline inwards at the same time so as to keep a connecting relationship with associated side walls of the water-cooled column to define and surround the enclosed space, then end the inward inclination and start to extend vertically upwards when they have extended to a certain position where the left and right side walls start to extend vertically upwards from the inward inclination, such that a cross section of an upper part of the water-cooled column has a shape of concaved octagon.

11. The furnace according to claim 8, wherein:

the furnace of the circulating fluidized bed boiler has an octagonal cross section and comprises: a front wall, a rear wall, a left side wall, a right side wall, a left front wall, a right front wall, a left rear wall, and a right rear wall;

the lower part of the water-cooled column is formed by eight water-cooled membrane walls connected together to define and surround the enclosed space and comprising: a front wall and a rear wall disposed opposite to each other and facing towards the front wall and the rear wall of the furnace respectively; a left side wall and a right side wall disposed opposite to each other and facing towards the left side wall and the right side wall of the furnace respectively; a left front wall located between the front wall and the left wall of the water-cooled column; a right front wall located between the front wall and the right wall of the water-cooled column; a left rear wall located between the rear wall and the left wall of the water-cooled column; and a right rear wall located between the rear wall and the right wall of the water-cooled column;

at the cross section reduced segment, each of the front wall, the rear wall, the left side wall and the right side wall of the water-cooled column extends obliquely upwards to provide a rectangular cross section, and each of the left front wall, the right front wall, the left rear wall and the right rear wall extends obliquely upwards and ends at a corresponding corner of the rectangular cross section.

12. The furnace according to claim 1, wherein:

a cross section of the furnace is a rectangle; and at least two water-cooled columns are disposed in the furnace and spaced apart from each other;

each water-cooled column is formed by four water-cooled membrane walls that are connected together to define and surround the enclosed space, one pair of water-cooled membrane walls of the four water-cooled membrane walls opposite to each other extend in parallel vertically, and the other pair of water-cooled membrane walls of the four water-cooled membrane walls opposite to each other extend obliquely upwards to approach each other in the vertical direction at the cross section reduced segment; and the at least two water-cooled columns have the same structure, and the water-cooled membrane walls of one of the water-cooled columns extending vertically at the cross section reduced segment are in parallel with the water-cooled membrane walls of the other of the water-cooled columns extending vertically at the cross section reduced segment.

13. The furnace according to claim 1, wherein a panel-typed heating plate is disposed at the upper part of the water-cooled column.

14. The furnace according to claim 1, wherein:

the cross section reduced segment has inclined side walls that incline inwardly to the inside of the water-cooled column; and side walls of the furnace facing the inclined side walls of the cross section reduced segment extend in the vertical direction.

15. The furnace according to claim 1, wherein:

the lower part of the water-cooled column provides an internal space for arranging a secondary air tube therein.

* * * * *